US008291742B2

(12) United States Patent
Haesemann et al.

(10) Patent No.: US 8,291,742 B2
(45) Date of Patent: Oct. 23, 2012

(54) PROCESS AND APPARATUS FOR PRODUCING A STRUCTURED SHEET-METAL STRIP

(75) Inventors: Gottfried Wilhelm Haesemann, Kürten (DE); Ludwig Wieres, Overath (DE)

(73) Assignee: EMITEC Gesellschaft fuer Emissionstechnologie mbH, Lohmar (DE)

( * ) Notice: Subject to any disclaimer, the term of this patent is extended or adjusted under 35 U.S.C. 154(b) by 1159 days.

(21) Appl. No.: 11/311,799

(22) Filed: Dec. 19, 2005

(65) Prior Publication Data

US 2006/0168810 A1 Aug. 3, 2006

Related U.S. Application Data

(63) Continuation of application No. PCT/EP2004/006205, filed on Jun. 9, 2004.

(30) Foreign Application Priority Data

Jun. 18, 2003 (DE) ..... 103 27 455

(51) Int. Cl.
*B21D 13/00* (2006.01)

(52) U.S. Cl. ..... 72/379.6; 72/192; 72/195

(58) Field of Classification Search ..... 72/379.6, 72/184, 185, 186, 187, 188, 189, 180, 385, 72/176, 339, 192, 194, 195, 196, 402, 420, 72/421; 29/890, 428, 890.03; 422/171, 177, 422/180

See application file for complete search history.

(56) References Cited

U.S. PATENT DOCUMENTS

| | | | | |
|---|---|---|---|---|
| 2,079,553 | A * | 5/1937 | Fraser | 72/396 |
| 2,484,943 | A * | 10/1949 | Guise et al. | 169/74 |
| 3,318,128 | A * | 5/1967 | Rhodes | 72/187 |
| 3,602,024 | A * | 8/1971 | Sabroff et al. | 72/60 |
| 3,736,787 | A | 6/1973 | Fencl et al. | |
| 3,756,202 | A * | 9/1973 | Keith | 122/156 |
| 3,972,260 | A * | 8/1976 | Hayashi et al. | 83/549 |
| 4,008,591 | A * | 2/1977 | Vos et al. | 72/38 |
| 4,098,722 | A * | 7/1978 | Cairns et al. | 502/336 |
| 4,275,581 | A * | 6/1981 | Miller | 72/385 |
| 4,277,374 | A * | 7/1981 | Lula et al. | 502/185 |
| 4,450,706 | A * | 5/1984 | Engelmohr | 72/385 |

(Continued)

FOREIGN PATENT DOCUMENTS

DE 1 008 692 B 5/1957

(Continued)

*Primary Examiner* — Dana Ross
*Assistant Examiner* — Homer Boyer
(74) *Attorney, Agent, or Firm* — Laurence A. Greenberg; Werner H. Sterner; Ralph E. Locher

(57) ABSTRACT

A method for producing a structured sheet-metal strip includes feeding a smooth sheet-metal strip to a shaping apparatus along a guiding direction. A primary structure is produced in the smooth sheet-metal strip through the use of the shaping apparatus, during which a number of separate shaping tools act upon the sheet-metal strip in a manner that is substantially perpendicular to the guiding direction. An apparatus for producing a structured sheet-metal strip can produce the structured sheet-metal strips with a particularly low ratio of corrugation length to corrugation height. Such structured sheet-metal strips are used, in particular, for producing purification components in mobile exhaust gas systems.

13 Claims, 5 Drawing Sheets

U.S. PATENT DOCUMENTS

| | | | | | |
|---|---|---|---|---|---|
| 5,261,840 | A | * | 11/1993 | Benz | 439/843 |
| 5,599,509 | A | * | 2/1997 | Toyao et al. | 422/180 |
| 5,791,186 | A | * | 8/1998 | Nishida et al. | 72/337 |
| 5,983,692 | A | * | 11/1999 | Bruck | 72/187 |
| 6,354,368 | B1 | * | 3/2002 | Nishishita et al. | 165/135 |
| 6,389,694 | B1 | * | 5/2002 | Tokunaga | 29/890 |
| 6,446,478 | B1 | * | 9/2002 | Muller | 72/306 |
| 6,964,225 | B2 | * | 11/2005 | Gubler et al. | 100/214 |
| 7,258,843 | B2 | * | 8/2007 | Bruck et al. | 422/180 |
| 7,727,498 | B2 | * | 6/2010 | Hodgson et al. | 423/210 |
| 2002/0134494 | A1 | * | 9/2002 | Bruck et al. | 156/205 |
| 2004/0013580 | A1 | * | 1/2004 | Bruck et al. | 422/171 |

FOREIGN PATENT DOCUMENTS

| | | | | |
|---|---|---|---|---|
| EP | 0 776 711 | A | | 6/1997 |
| GB | 1301667 | A | * | 1/1973 |
| GB | 1557780 | A | * | 12/1979 |
| JP | 41016197 | Y1 | | 7/1966 |
| JP | 58196128 | A | | 11/1983 |
| JP | 59035832 | A | | 2/1984 |
| JP | 59056939 | A | | 4/1984 |
| JP | 63264221 | A | | 11/1988 |
| JP | 5146827 | A | | 6/1993 |
| JP | 10160375 | A | | 6/1998 |
| JP | 11179438 | A | | 7/1999 |
| JP | 2002 224752 | A | | 8/2002 |
| JP | 2003019515 | A | | 1/2003 |
| SU | 508 302 | | | 3/1976 |
| SU | 508 302 | A | | 3/1976 |

* cited by examiner

PROCESS AND APPARATUS FOR PRODUCING A STRUCTURED SHEET-METAL STRIP

CROSS-REFERENCE TO RELATED APPLICATION

This is a continuation, under 35 U.S.C. §120, of copending International Application No. PCT/EP2004/006205, filed Jun. 9, 2004, which designated the United States; this application also claims the priority, under 35 U.S.C. §119, of German Patent Application 103 27 455.3, filed Jun. 18, 2003; the prior applications are herewith incorporated by reference in their entirety.

BACKGROUND OF THE INVENTION

Field of the Invention

The present invention relates to a process for producing a structured sheet-metal strip with a primary structure, and to an apparatus for introducing at least one primary structure into a sheet-metal strip. Such structured sheet-metal strips are preferably used to produce exhaust-gas purification components for mobile internal combustion engines.

In order to treat the exhaust gasses from mobile internal combustion engines, such as for example spark-ignition and diesel engines, it is known for components or structures which provide a relatively large surface area to be disposed in an exhaust line. Those components are usually provided with an adsorbent, catalytically active or similar coating. Intimate contact with the exhaust gas flowing past is realized due to the large surface area of the components. Examples of such components include filter elements for filtering out particulates contained in the exhaust gas, adsorbers for storing pollutants (e.g. $NO_x$) contained in the exhaust gas at least for a limited period of time, catalytic converters (e.g. 3-way catalytic converters, oxidation catalytic converters, reduction catalytic converters, etc.), diffusers for influencing the flow of and/or swirling up the exhaust gas flowing through, or alternatively heating elements which heat the exhaust gas to a predetermined temperature in particular immediately after a cold start by the internal combustion engine. Taking into account the conditions of use in the exhaust system of an automobile, the following carrier substrates have proven fundamentally suitable: ceramic honeycomb bodies, extruded honeycomb bodies and honeycomb bodies made from metal foils. Due to the fact that those carrier substrates have to be constantly adapted in terms of their functions, high-temperature-resistant and corrosion-resistant sheet-metal foils are particularly suitable for use as starting materials.

It is known to produce honeycomb bodies with a plurality of at least partially structured sheet-metal foils, which are then introduced into a housing or casing so as to form a carrier body which can be provided with one or more of the coatings mentioned above. The at least partially structured sheet-metal foils are disposed in such a way as to form passages disposed substantially parallel to one another. In order to ensure the formation of the passages, by way of example, part of the sheet-metal foil is provided with a primary structure, which is distinguished, inter alia, by a regular, recurring structure, in particular a type of sine wave, a saw tooth structure, a square-wave corrugation, a delta-wave corrugation, an omega corrugation or the like. Sheet-metal foils provided with a primary structure are then stacked on top of one another (if appropriate alternating with smooth interlayers), intertwined and fitted into a housing or casing. After the sheet-metal foils have been joined to the housing, the result is a honeycomb body which has substantially parallel passages.

It is also known to introduce a second, small structure into those sheet-metal foils (smooth foils and/or ones which have a primary structure), which is intended in particular to prevent a laminar flow from forming immediately after the exhaust gas has entered the honeycomb body, in which case there would be no exchange of gas between regions of the partial exhaust-gas stream lying in the center of a passage of that type with the, for example, catalytically active passage wall regions. Accordingly, that secondary structure provides flow-facing surfaces, causing the partial exhaust-gas streams in the interior of a passage of that type to be swirled up. That leads to intensive mixing of the partial exhaust-gas streams themselves, so that intimate contact of the pollutants contained in the exhaust gas with the passage wall is ensured. It is also possible to use secondary structures of that type to form flow channels running transversely to the passage, allowing gas exchange of partial exhaust-gas streams into adjacent passages. For that reason, there are known secondary structures which include, for example, guide surfaces, microstructures, lugs, projections, vanes, tabs, holes or the like. In that respect, the result is a considerably broader range of variations when producing metallic honeycomb bodies as compared to those made from ceramic material, since an extrusion operation cannot realize such a complex passage wall, or can only do so at particularly high technical cost.

Furthermore, it is of particular interest for exhaust-gas treatment for the pollutants contained in the exhaust gas to be converted almost immediately after the engine has started. According to statutory stipulations or guidelines, that should take place with a particularly high efficiency. For that reason, in the past increasingly thin sheet-metal foils have been used. Very thin sheet-metal foils mean that there is a very low area-specific heat capacity. That means that relatively little heat is extracted from the exhaust gas flowing past, or the sheet-metal foils themselves undergo an increase in temperature relatively quickly. That is important because, for example, the catalytically active coatings currently used in the exhaust system only start to convert the pollutants above a certain light-off temperature, which is approximately at temperatures of from 230° C. to 270° C. With a view toward converting the pollutants with at least a 98% efficiency after just a few seconds, sheet-metal foils with a thickness of, for example, less than 20 μm are used.

However, in view of the objectives listed above, there are a number of manufacturing and application problems. The production of such fine structures, in particular the secondary structures, requires particularly precise tools which are usually very expensive and accordingly ought to achieve long service lives. In that context, it should also be noted that the relatively thin foil thickness requires relatively "gentle" deformation. Such thin metal foils are particularly prone to cold work-hardening, which occurs in particular in the event of multiple deformations. That leads to embrittlement of the material and, in particular in view of the high thermal and dynamic loads which occur in the exhaust system, can quickly lead to component failure. Moreover, it should be taken into account that the sheet-metal foils generally must not be squeezed during deformation, since that can quickly lead to the material tearing. Such cracks, which are in some cases very small, represent crack propagation sources, which likewise endanger the functionality of the component due to the fluctuating thermal stresses during subsequent use. Furthermore, the sheet-metal foils should be prevented from their tendency to crease or roll up during production. The creases result, for example, under certain circumstances, in passages becoming blocked or cracks forming. The cracks propagate due to the subsequent stresses in the exhaust system of an automobile, endangering the structural integrity of the honeycomb body. It should also be noted that creased or deformed primary and/or secondary structures of that nature represent undesired opposition to the exhaust gas, so that under certain circumstances an increased dynamic pressure is observed upstream of the exhaust-gas body, which can lead to a reduction in the engine power.

It is known for the sheet-metal foil to be provided with a primary structure through the use of profiling tools which engage in one another, for example by the corrugation rolling process. The smooth sheet-metal strip is guided through two circumferentially profiled rollers, with the roller axes positioned perpendicular to the bending plane. The rollers are equipped, for example, with involute profiling teeth, with the profiling teeth of the rollers engaging in one another. However, in that case there is a risk of the sheet-metal strip that is to be deformed becoming partially jammed against the flanks or sides of the profiling teeth, with simultaneous deformation by the profiling tooth head. That often leads to the material being compressed in the region of the flanks or sides and in cracks being formed in the vicinity of the profiling tooth head. A further restriction in connection with that production process is that the primary structure which is generated substantially reproduces the profile of the corrugation rollers, which is itself limited by the fact that the teeth roll along one another or require a certain rigidity due to the rolling phenomenon. In that case, it is only possible to produce very specific ratios of corrugation length to corrugation height of the primary structure.

SUMMARY OF THE INVENTION

It is accordingly an object of the invention to provide a process and an apparatus for producing a structured sheet-metal strip, which overcome the hereinafore-mentioned disadvantages and technical problems of the heretofore-known processes and apparatuses of this general type, in which the process is inexpensive, can preferably be carried out continuously, avoids excessive cold work-hardening of the sheet-metal foils, allows a very wide range of primary and secondary structures to be implemented and generates a primary structure which is suitable for the exhaust gas of mobile internal combustion engines. The intention is for the carrier body to have a very low flow resistance, in particular at high passage densities and with an integrated secondary structure. Furthermore, the apparatus or tool for producing structured sheet-metal strips of this type should be suitable for introducing or altering particularly complex structures in thin sheet-metal foils so that the structures are advantageous in terms of flow.

With the foregoing and other objects in view there is provided, in accordance with the invention, a process for producing a structured sheet-metal strip. The process comprises feeding a smooth sheet-metal strip along a guide direction to a shaping apparatus having a plurality of separate shaping tools. A primary structure is introduced into the smooth sheet-metal strip by using the plurality of separate shaping tools acting on the sheet-metal strip substantially perpendicularly to the guide direction.

One significant feature of this production process is that the primary structure is no longer produced by rotating profiling tools which engage in one another, but rather a plurality of separate shaping tools execute a type of reciprocating movement and press the smooth sheet-metal strip into a predetermined mating die. Due to the fact that the separate shaping tools move toward the mating die with a substantially perpendicular movement, it is possible to achieve a wide range of different embodiments of any desired construction for a primary structure. Since in this case a plurality of separate shaping tools are used, it is possible to further reduce the material loading. This specifically means that each shaping tool machines only a relatively small area of the sheet-metal strip, with the change in position of the sheet-metal strip (if appropriate in the spaces between adjacent shaping tools or by a defined, temporal sequence of the reciprocating movements of the shaping tools) being compensated for due to the offset, progressive deformation operation. This leads to the primary structure being generated in a manner which is particularly gentle on the material.

The term "plurality of separate shaping tools" is to be understood as meaning at least two, preferably at least 10 and in particular even more than 20, separate shaping tools. This number in particular relates only to the shaping tools which are disposed on the same side of the sheet-metal strip, whereas a mating die is preferably positioned on the opposite side of the sheet-metal strip. A mating die of this type usually has a plurality of extremities in which the separate shaping tools engage, under certain circumstances almost coming to bear against them (so that the gap corresponds approximately only to the sheet-metal thickness). If these extremities of the mating die are considered, they usually lie on a straight or curved line. This line lies substantially parallel to the guide direction of the sheet-metal strip through the shaping apparatus. The separate shaping tools are moved substantially perpendicular in relation to precisely this guide device or this line. A more detailed description of this process is given below with regard to different tools.

In accordance with another mode of the invention, the structured sheet-metal strip is severed after the primary structure has been introduced, so as to produce sheet-metal foils. Whereas the process described above is preferably carried out with a sheet-metal strip drawn from a coil, in particular the exhaust-gas purification components described in the introduction use sheet-metal foils of a defined length. This length depends mainly on the structure of the honeycomb body. Lengths of, for example, up to 40 cm in the case of helically wound sheet-metal foils or alternatively of just 12 cm in the case, for example, of sheet-metal foils wound in an S-shape, are used to produce carrier bodies.

In accordance with a further mode of the invention, the structured sheet-metal strip is produced with a primary structure which is distinguished by a corrugation length and a corrugation height. A ratio of the corrugation length to the corrugation height is less than 2, in particular less than 1.5. In principle, it should be noted first of all that the terms "corrugation length" and "corrugation height" can be applied not only to a "corrugation"-like primary structure, but rather these ratios can also be applied in a similar way to other primary structures. In this context, the corrugation length describes the distance between two extremities of the same type, for example two directly adjacent corrugation peaks or two directly adjacent corrugation valleys. This makes it clear that what this means therefore is the repetition length of the primary structure. The term corrugation height is to be understood as meaning the distance between two opposite extremities, i.e. for example the distance between a corrugation peak and the adjacent corrugation valley. The corrugation length and the corrugation height are usually perpendicular to one another.

A ratio of corrugation length to corrugation height of less than 2, in particular less than 1.5, describes primary structures with relatively steeply dropping flanks or sides. Primary structures of this type form passages with advantageous properties during subsequent assembly to form a honeycomb structure (of a carrier body through which the exhaust gas can flow). For example, it is possible in a relatively simple way to provide the required quantity of brazing material and/or coating in the pockets, i.e. in the contact regions between sheet-metal foils disposed adjacent one another, allowing a very inexpensive procedure to be adopted. Furthermore, passages of this type are distinguished by improved flow properties, in particular since the flanks or sides are relatively close together, and intimate contact between the exhaust gas flowing through and the partially coated passage walls is possible.

In accordance with an added mode of the invention, the sheet-metal strip or the sheet-metal foil is made from a high-temperature-resistant and corrosion-resistant material and has a thickness of less than 0.11 mm, in particular less than 0.06 mm and preferably even 0.03 mm. The material preferably contains chromium and/or aluminum, (generally with an iron base) and/or includes a nickel base. In particular with these materials, in the thicknesses indicated, it was previously likely that the materials would be damaged during the introduction of the primary structure. This was caused firstly by the fact that the materials described are very prone to cold work-hardening and secondly by the fact that their material thickness constituted a risk. In this respect, the proposed process with the separate shaping tools which act on the sheet-metal strip substantially perpendicularly to the guide direction is especially advantageous for the materials and material thicknesses mentioned herein. With the sheet-metal foils as distinguished in the description, it is advantageously possible to produce carrier bodies which have a passage density of more than 200 cpsi (cells per square inch), in particular more than 400 cpsi and preferably even more than 800 cpsi.

In accordance with an additional mode of the invention, before the sheet-metal strip is introduced into the shaping apparatus, holes and/or slots are introduced into the sheet-metal strip, in particular by the stamping manufacturing process. Holes of this type, for example with a diameter of from 2 mm to 6 mm, are usually used as a channel for partial exhaust-gas streams in exhaust-gas purification components, allowing gas exchange between adjacent passages. The slots usually serve as a starting point for the secondary structure, which is produced at the locations of the slots by deformation of the sheet-metal strip, for example by overturning, bending, widening, etc. In particular, guide surfaces, vanes or similar structures are formed. However, it is also possible for the holes to be disposed directly at the slots. This is to be understood as meaning in particular that the slots have widenings in the edge regions, reducing the notch effect. In this case, the holes or widenings have a radius of much less than 1 mm. In principle, it should also be noted that the person skilled in the art is aware of numerous production processes which can be used to introduce holes and/or slots (if appropriate in combination) of this type into a sheet-metal strip. In this context, particular favor is given to the stamping production process, since it can be used at particularly low cost even as part of series production.

In accordance with yet another mode of the invention, the sheet-metal strip, after the primary structure has been introduced, is provided with a secondary structure through the use of intermeshing profiling tools. This secondary structure preferably at least partially delimits holes and/or slots in the sheet-metal strip. This process step is usually carried out even before the structured sheet-metal strip has been severed to produce separate sheet-metal foils. The intermeshing profiling tools mentioned herein are to be understood in particular as meaning tools which do not have any flanks or sides that roll along one another. Rather, they are pin-like structures which preferably only come into contact with those regions of the sheet-metal strip at which the secondary structure is subsequently formed. In this context, the holes and/or slots are used, for example, as positioning aids.

With the objects of the invention in view, there is also provided an apparatus for introducing at least one primary structure into a sheet-metal strip being supplied in a guide direction. The apparatus comprises a plurality of separate shaping tools disposed next to one another. Each of the shaping tools has a contact surface substantially corresponding to a section of the primary structure. The shaping tools are movable substantially perpendicularly to the guide direction of the sheet-metal strip. The shaping tools are movable at least partially offset relative to one another. With regard to this apparatus, reference is made at this point to the explanations which have already been given above in connection with the process.

Furthermore, it should be noted that the term "contact surface" is to be understood as meaning that part of the shaping tools which comes into contact with the sheet-metal strip, i.e. partially brings about its deformation. This contact surface is constructed in such a way that it substantially produces part of the primary structure, ensuring that the shaping tools can push or press the sheet-metal strip with the desired primary structure into, for example, a mating die. The configuration of the separate shaping tools next to one another is preferably such that in the event that all of the shaping tools are in engagement with the sheet-metal strip or the mating die (i.e. are at their maximum extension), the contact surfaces of the shaping tools adjoin one another and/or are positioned substantially parallel to a profile of the mating die.

The offset movement of the separate shaping tools with respect to one another ensures that sufficient material of the sheet-metal strip can be drawn into the deformation region, and therefore excessive stressing of the sheet-metal strip during deformation is avoided (excessive stretching, excessive compression, cold work-hardening, etc.). This makes it clear that a relatively large region of the sheet-metal strip is disposed close to the shaping tools, but this region is deformed at different instants and/or with different intensities at the same time. Accordingly, an "offset movement" is to be understood as meaning that the reciprocating movement of shaping tools disposed adjacent one another takes place at different times, at different speeds, with different forces and/or with different directions of force action.

It is preferable for the sheet-metal strip to be deformed in such a manner that an outer shaping tool (or a shaping tool disposed last in the guide direction) starts the reciprocating movement, and the adjoining shaping tools carry out their reciprocating movement in succession in terms of time until the other, opposite shaping tool (or the one disposed first in the guide direction) is reached. It is in this context particularly advantageous if at no point in time during the deformation step are all of the separate shaping tools in engagement with the sheet-metal strip. Rather, at most half of the separate shaping tools, in particular less than one third of the separate shaping tools, should be in contact with the sheet-metal strip. On the other hand, at least 2, preferably at least 3, in particular at least 5 such shaping tools should simultaneously exert a force on the sheet-metal strip during deformation in order to allow secure holding and continuous deformation.

In accordance with another feature of the invention, the primary structure has a corrugation length and a corrugation height, and the ratio of corrugation length to corrugation height is preferably less than 2. The shaping tools have a width which is less than 10 times the corrugation length, in particular less than 5 times the corrugation length. Reference should be made to the statements given above for a definition of the terms corrugation height and corrugation length. The width of the separate shaping tools is defined in more detail for the apparatus described herein. Relatively narrow shaping tools which only form a defined number of corrugation peaks or corrugation valleys are indicated. It is very particularly preferable for the width of the shaping tools to correspond to substantially double the wavelength. This relatively narrow construction of the shaping tools leads to particularly gentle deformation of the sheet-metal strip, since only a very limited region of the sheet-metal strip is being simultaneously deformed. This significantly reduces material flow in the sheet-metal strip as a result of compression or stretching.

In accordance with a further feature of the invention, there is provided a device which ensures a spatially offset reciprocating movement of the separate shaping tools. It is preferably possible for the reciprocating movements of adjacent shaping tools to overlap in terms of time. The term "spatially offset reciprocating movement" is to be understood as meaning in particular that all of the shaping tools execute a reciprocating movement of the same magnitude, but these movements take place differently during the deformation process, so that at least a plurality of the shaping tools are at different stages in terms of their reciprocating movement. The term "the reciprocating movements to overlap in terms of time" is to be understood in particular as meaning that a plurality of shaping tools are not simultaneously in their extreme positions, but rather are executing the reciprocating movement.

In accordance with an added feature of the invention, there is provided a device for ensuring a reciprocating movement. The device includes a camshaft with cams that are offset with respect to one another in the direction of rotation. A camshaft of this type may be constructed, for example, in such a manner that it has a plurality of cam sections which are disposed next to one another as seen in the axial direction and are disposed offset with respect to one another in the direction of rotation, or have cam maxima which are offset with respect to one another in the direction of rotation. It is customary for the number of cams to correspond to the number of the plurality of separate, adjacent shaping tools which are brought into contact with the cams in such a way that they execute their reciprocating movement. The reciprocating movement can easily be adapted by the special configuration of the cams, so that the velocity or the lifting movement can easily be adjusted by the profile of the cams. In order to make adjacent shaping tools overlap in terms of time, the corresponding cams at least partially overlap, when the camshaft is seen from the end side in the direction of rotation.

In accordance with an additional feature of the invention, the device includes a carriage which is disposed in such a way that it can move relative to the shaping tools, and in such a way that a reciprocating movement is produced by the relative movement and a suitable connection of the carriage to the shaping tools. Whereas in the case of the camshaft described above the relative movement is generated by a rotary movement of the camshaft, the carriage describes a translational or similar movement, which is carried out in particular through the use of a suitable guide. In other words, this means that a carriage of this type is successively brought into contact with the separate shaping tools in such a way that it exerts a force which leads to a reciprocating movement. By way of example, this can be realized by a carriage of this type being moved past on the opposite side from the contact surfaces of the shaping tools, with a running surface pressing the shaping tools toward the position of the sheet-metal strip. The reciprocating movement, in particular its velocity and travel, can be set by suitable profiling of this surface. It is also possible to influence the cycle frequency of the machining steps through the use of the velocity at which the carriage is guided past the shaping tools.

In accordance with yet another feature of the invention, the separate shaping tools are disposed parallel to one another. This means, in other words, that the guide direction of the sheet-metal strip is likewise substantially straight. With the shaping tools disposed in this way, it is particularly recommended for the reciprocating movement to be generated through the use of the camshaft described above.

In accordance with yet a further feature of the invention, alternatively, the shaping tools are disposed obliquely with respect to one another, in particular at an angle, starting from their contact surfaces, of at least 50. Depending on the space required for the shaping tools and the sheet-metal strip working region of the shaping tools, this angle may also vary or be larger, for example approximately 10°, 15°, 20°, etc.

It is very particularly advantageous in this context for the shaping tools to be in a radiating configuration, with a profile wheel provided in a center. With an inclined configuration of the shaping tools of this nature, it is usually assumed that the regions of the shaping tools which form the contact surfaces are at the shortest distance from one another. The inclined configuration of the shaping tools allows the apparatus to have a relatively compact construction. The shaping tools, between which there is preferably always the same angle, can ultimately cover a virtually circular area. However, it is also possible for only parts of a circle, such as for example a semicircle or three quarters of a circle, to be formed by the shaping tools.

In accordance with yet an added feature of the invention, the shaping tools execute a reciprocating movement which is directed radially inward, toward the center, when deformation of the sheet-metal strip is to be carried out. A profile wheel which includes substantially the negative form of the contact surfaces of the shaping tools is provided as a mating die in the center. This profile wheel can simultaneously be used to advance the structured sheet-metal strip if it is connected to a suitable drive unit. During the formation of the primary structure, i.e. during the reciprocating movement of the shaping tools, however, there is no movement of the profile wheel with respect to the shaping tools in the guide direction.

In accordance with yet an additional feature of the invention, the profile wheel has a direction of rotation, and a carriage guided on an outer circuit has an opposite direction of movement. This once again realizes the principle whereby the deformation of the sheet-metal strip or the production of the primary structure always continues from the region of the sheet-metal strip which has already been deformed in the opposite direction to the guide direction. This ensures that smooth regions of the sheet-metal strip can be drawn into the profiles.

In accordance with still another feature of the invention, there is provided a device for continuously feeding and discharging the sheet-metal strip, which preferably ensures an advance of at least 20 m/min (meters per minute). In this context, the term "continuously feeding and discharging" is to be understood in particular as meaning that there is a continuous, uninterrupted, automatic transporting of the sheet-metal strip, with an advance of at least 20 m/min being achieved on average over the course of an hour.

In accordance with a concomitant feature of the invention, the device for ensuring the reciprocating movement of the separate shaping tools is connected to a drive which drives at least one further device from the following list of devices: a feed device for the sheet-metal strip, a profiling device for producing a secondary structure with intermeshing profiling tools, a stamping device for producing holes and/or slots in the sheet-metal strip, and a severing device for producing separate sheet-metal foils from the sheet-metal strip.

This ensures that the further process steps used for deformation of the sheet-metal strip or all of the preceding process steps are precisely matched to the movement sequence in the shaping apparatus. Although it would also be possible for matching of the movements of this type to be achieved through the use of EDP tools and/or software, for process reliability reasons in this case it is preferable for the individual drive units to be coupled by suitable drive trains.

Other features which are considered as characteristic for the invention are set forth in the appended claims.

Although the invention is illustrated and described herein as embodied in a process and an apparatus for producing a structured sheet-metal strip, it is nevertheless not intended to be limited to the details shown, since various modifications and structural changes may be made therein without departing from the spirit of the invention and within the scope and range of equivalents of the claims in which the features mentioned therein can be combined with one another in any desired way.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
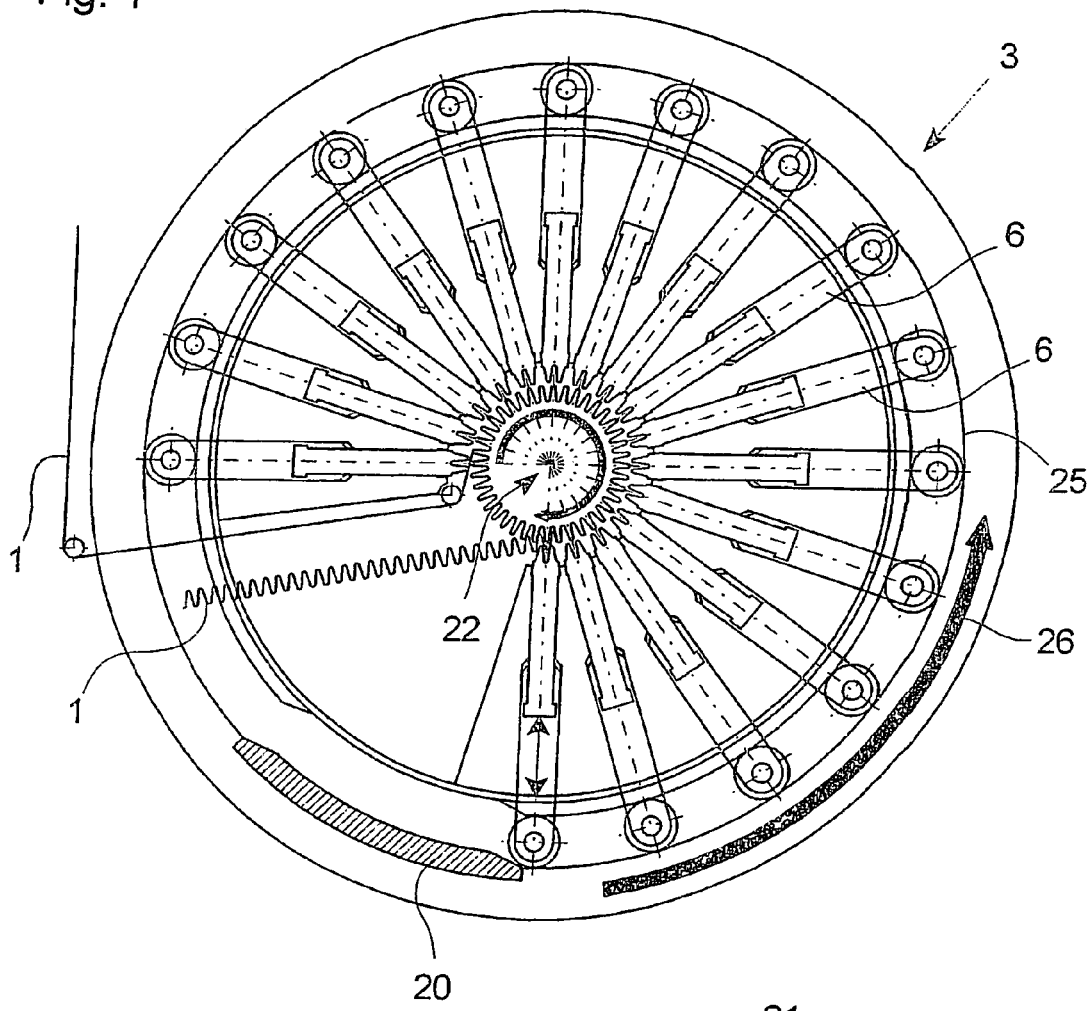
FIG. 1 is a diagrammatic, side-elevational view of a first exemplary embodiment of an apparatus according to the invention.
Figure 2:
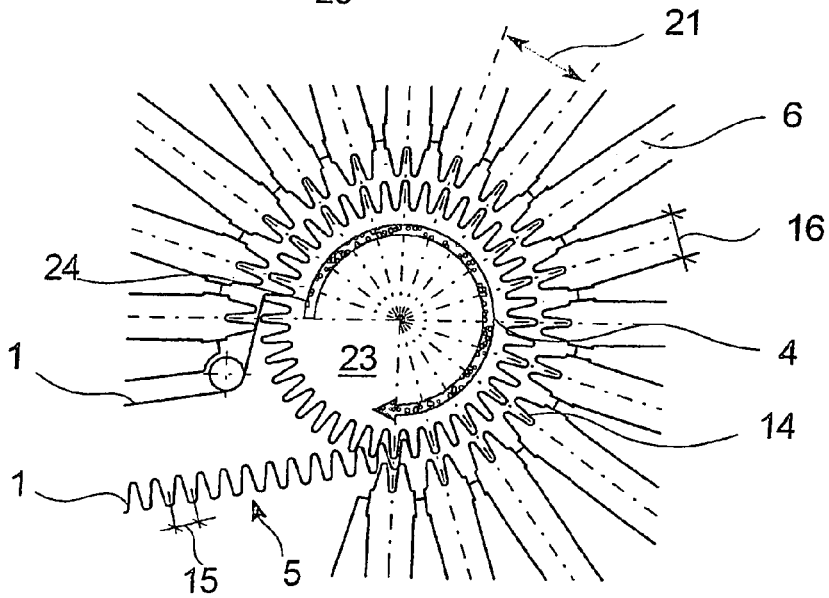
FIG. 2 is an enlarged, fragmentary, side-elevational view of the exemplary embodiment of FIG. 1.

Referring now in detail to the figures of the drawings, which show particularly preferred, advantageous exemplary embodiments but do not, however, constitute any restriction on the invention, and first, particularly, to FIGS. 1 and 2 thereof, there is seen an apparatus 3 for introducing at least one primary structure 5 into a sheet-metal strip 1 that is being supplied. The apparatus 3 has a plurality of separate shaping tools 6 which are disposed next to one another and each have a contact surface 14 substantially corresponding to a section 15 of the primary structure 5. This can be seen in particular from the enlarged subregion illustrated in FIG. 2. The shaping tools 6 can move substantially perpendicular to a guide direction 4 of the sheet-metal strip 1 and at least partially offset with respect to one another. The apparatus 3 has a device for generating a reciprocating movement 33 (shown in FIG. 3) of the shaping tools 6, so that the reciprocating movement 33 of adjacent shaping tools 6 overlap in terms of time. This device includes a carriage 20, which is disposed in such a way that it can move relative to the shaping tool 6 and in such a way that the reciprocating movement 33 is generated by a relative movement and a suitable connection of the carriage 20 to the shaping tools 6.

In this case, the shaping tools 6 are disposed obliquely, in particular in radiating fashion, with respect to one another. The tools 6 are at an angle 21, starting from their contact surfaces 14, of at least 100. It is preferable for the carriage 20 to be driven at a uniform velocity on a circuit 25 with a direction of movement 26. In this case it is preferable to provide a region during which the carriage 20 is not in contact with a shaping tool 6 during its movement, as shown in a lower left subsection. This subsection, or the time which the carriage 20 needs to pass through this subsection, is used to realize an advance with regard to the sheet-metal strip 1. For this purpose, a profile wheel 23 in the center 22 rotates in a direction of rotation 24. It is preferable for the profile wheel 23 to rotate sufficiently far for the primary structure 5 formed last to then be positioned precisely in the vicinity of the shaping tool 6 disposed last in the guide direction 4. This advancing operation is concluded when the carriage 20 just reaches this shaping tool 6 disposed last and causes it to execute a reciprocating movement 33.

Figure 3:
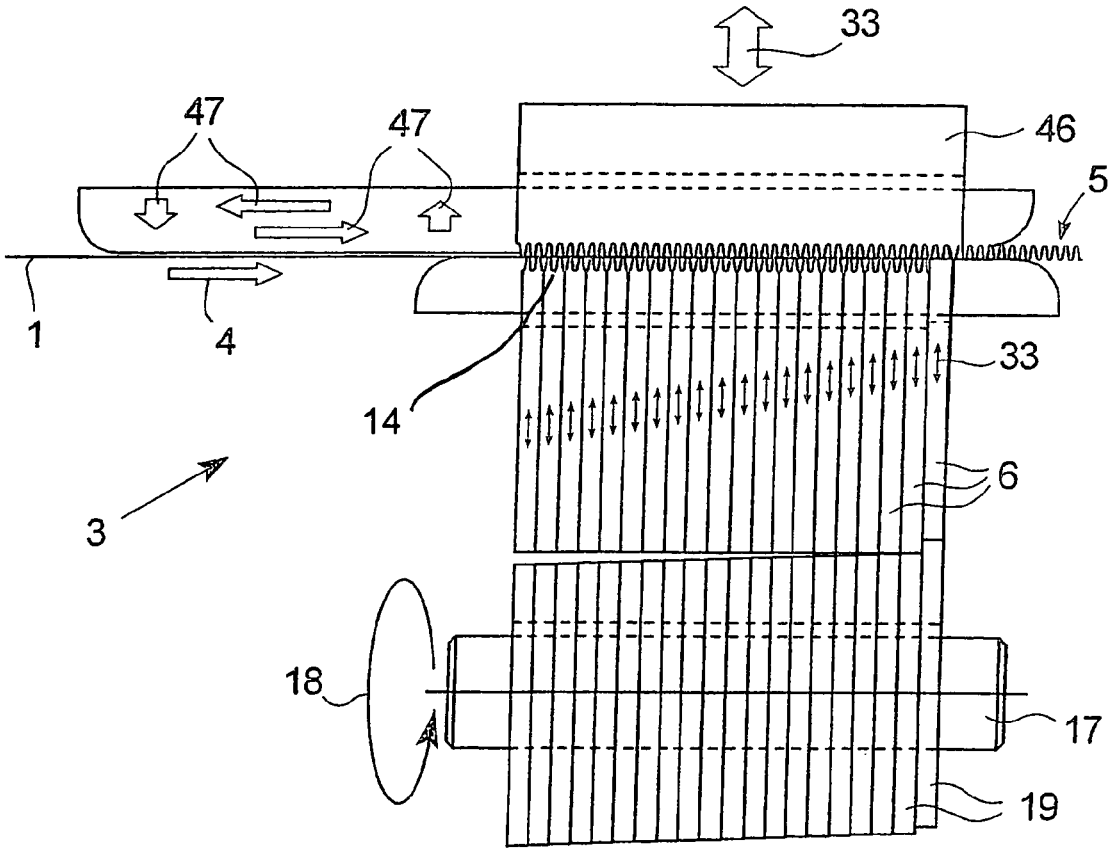
FIG. 3 is an elevational view of a further exemplary embodiment of the apparatus according to the invention.

FIG. 3 diagrammatically illustrates a further exemplary embodiment of a shaping apparatus 3 for producing structured sheet-metal strips 1 with a primary structure 5. Once again, a plurality of shaping tools 6, in this case disposed substantially parallel to one another, are provided and can execute the reciprocating movement 33 offset with respect to one another. In order to generate this reciprocating movement 33, a camshaft 17 with cams 19 disposed offset with respect to one another in a direction of rotation 18 is provided on a side remote from the contact surfaces 14 of the shaping tools 6. In the illustrated exemplary embodiment, these cams 19 press the shaping tools 6 upwards and a reduction in the diameter of the cam 19 in turn leads to the shaping tools 6 being lowered. As can be seen from FIG. 3, the cams 19 disposed adjacent one another form a falling or rising gradient, with the cams 19 coming into contact with different shaping tools 6 at different times, depending on the angle of rotation of the camshaft 17.

As a result of the reciprocating movement 33, the shaping tools 6 press the sheet-metal strip 1 into a mating die 46, which can likewise execute a reciprocating movement 33 in this case. In the illustrated exemplary embodiment, first of all the shaping tools 6 disposed on the right-hand side begin deformation of the sheet-metal strip 1 and gradually, the shaping tools 6 disposed further to the left start to effect deformation. Once, finally, the outermost shaping tool 6, located at the far left in the illustration, has completed its reciprocating movement 33, the mating die 46 is used to effect an advance of the sheet-metal strip 1 by moving in a direction indicated by arrows 47. At this point, the shaping tools 6 are no longer in engagement with the primary structure 5 of the sheet-metal strip 1, the mating die 46 moves partially to the right in the illustration and is then lifted off upward and then moves back toward the left, so that its profiling is once again disposed directly opposite the contact surfaces 14 of the shaping tools 6. Then, a smooth section of the sheet-metal strip 1 is once again located between the shaping tools 6 and the mating die 46. As an alternative to or in combination with the advance being generated by the mating die 46 itself, it is in principle also possible for separate elements to be provided for this purpose. By way of example, comb-like elements can be provided in the mating die 46, serving as "ejectors", so that they can preferably be moved relative to the mating die 46. These "ejectors" may therefore also serve to transport the sheet-metal strip 1 onwards, in which case the heavy mating die 46 then only executes an up-and-down movement. The comb-like elements can additionally be used to calibrate or fine-tune the desired corrugation height.

In this exemplary embodiment too, it is possible for the cams 19 of the camshaft 17 to be configured in such a way that at a defined point in time or for a defined period of time, none of the cams 19 are in contact with the shaping tools 6, and precisely this point in time or period of time is used to advance the sheet-metal strip 1. This has the advantage of permitting the camshaft 17 to always be able to be driven continuously at the same velocity.

Figures 4, 4A:
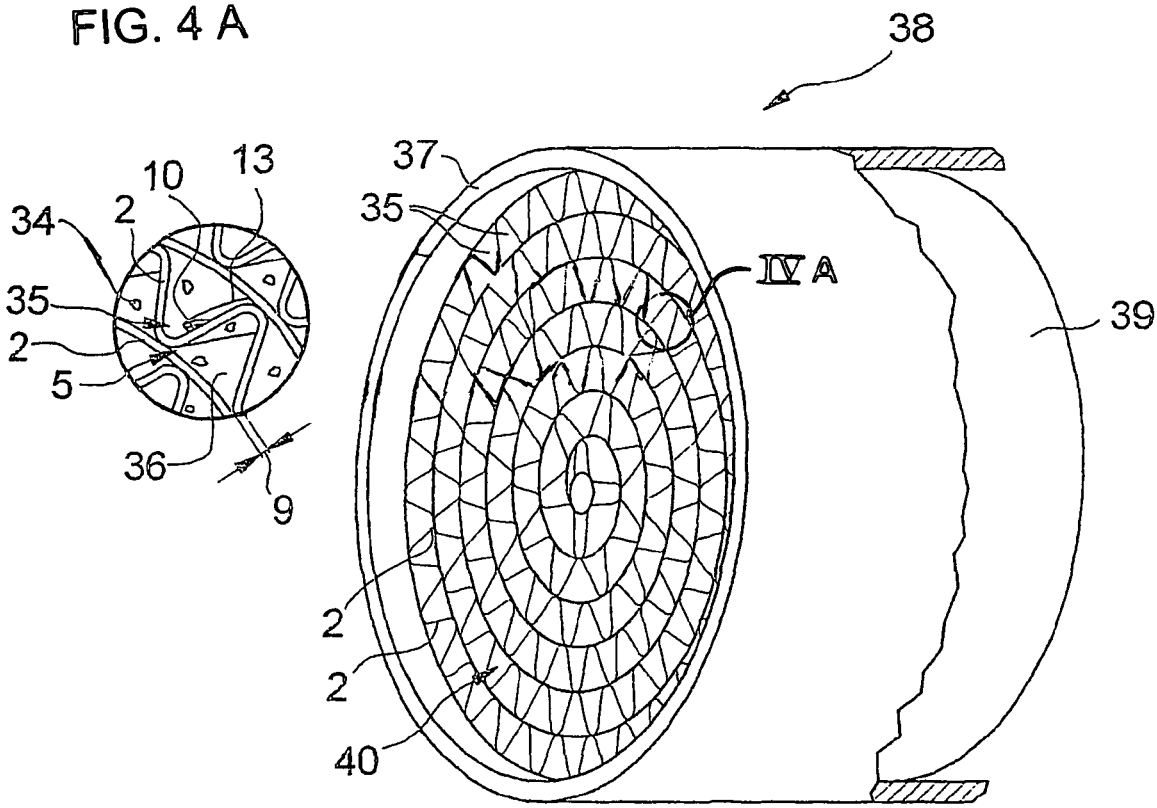
FIG. 4 is a partly broken-away, perspective view of a carrier body for an exhaust-gas purification component with a sheet-metal foil in accordance with the process of the invention.
FIG. 4A is an enlarged, end-elevational view of a portion IV A of FIG. 4.

FIG. 4 shows a diagrammatic, perspective illustration of a carrier body 38 as an exhaust-gas purification component for mobile applications, such as for example automobiles, motorcycles, lawnmowers, etc. Sheet-metal foils or sheets 2 produced by the above-described process or using the apparatus as described above are stacked or layered and then intertwined or wound up in such a way that they form a honeycomb structure 39 with a plurality of passages 35 disposed substantially parallel to one another. This honeycomb structure 39 is usually inserted into a corresponding housing or casing 37 and joined to it, in particular by a brazing process. The resulting carrier body 38 can be used as a catalytic converter, a particulate trap, an adsorber, a flow mixer, etc. In this context, preference is given to the passages 35 which extend substantially continuously from one end side 40 to an opposite end side. It is also possible to provide for adjacent passages 35 to be connected to one another.

In FIG. 4A which is illustrated on a larger scale, it is once again possible to see sheet-metal foils 2, with some of the sheet-metal foils 2 having a primary structure 5. Moreover, the sheet-metal foils 2 have a secondary structure 13 at least partially delimited by a hole 10. These holes 10 ensure that a gas exchange with respect to adjacent passages 35 is possible. The primary structure 5 of the sheet-metal foil 2 ensures a very large surface area 36 of the carrier body 38, so that intimate contact of exhaust gas with a coating 34 disposed on the surface 36 is possible. In order to effect rapid conversion through the use of the coating 34, the sheet-metal foils 2 preferably have a thickness 9 of less than 0.1 mm, in particular less than 0.5 mm.

Figure 5:
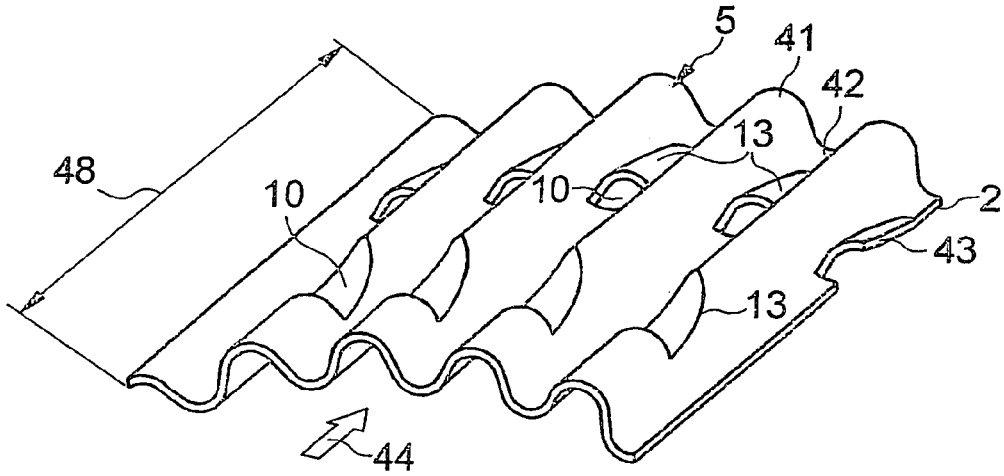
FIG. 5 is a perspective view of an exemplary embodiment of a structured sheet-metal layer as can be produced by the process according to the invention.

FIG. 5 shows a diagrammatic and perspective illustration of a sheet-metal foil 2 with a primary structure 5 and a secondary structure 13. The primary structure 5 has a corrugation-like configuration and has corrugation peaks 41 and corrugation valleys 42. The corrugation peaks 41 and corrugation valleys 42 run substantially parallel to one another over an entire length 48 of the sheet-metal foil 2. In addition, the sheet-metal foil 2 is provided with the secondary structure 13 which includes a plurality of guide surfaces 43 that extend upwards from the corrugation valleys 42 and downwards from the corrugation peaks 41. In the vicinity of these guide surfaces 43 are the holes 10 which peel off an interfacial or boundary flow in a direction of flow 44 along the sheet-metal foil 2 and divert it into adjacent subregions.

FIGS. 6A to 6D diagrammatically illustrate a progression of the process for producing multiply structured sheet-metal foils 2 or sheet-metal strips 1. A step denoted by FIG. 6A includes the introduction of a number of slots 11 into an inner region of the substantially planar sheet-metal strip 1. In the embodiment illustrated, the slots 11 are disposed substantially parallel to the edges of the sheet-metal strip 1, but this is not necessarily the case. The slots 11 can be provided in any desired configuration with respect to one another. In this case, the slots 11 are at least partially also illustrated together with the holes 10 in the edge regions. The holes 10 have the task of preventing crack propagation starting from the edge regions of the slots 11 after the secondary structure 13 has been formed.

Figure 6A:
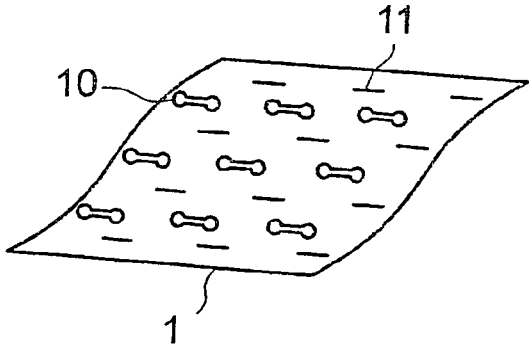
FIGS. 6A, 6B, 6C and 6D are perspective views depicting a production sequence of a structured sheet-metal strip which can be used as a catalyst carrier body.
Figure 6B:
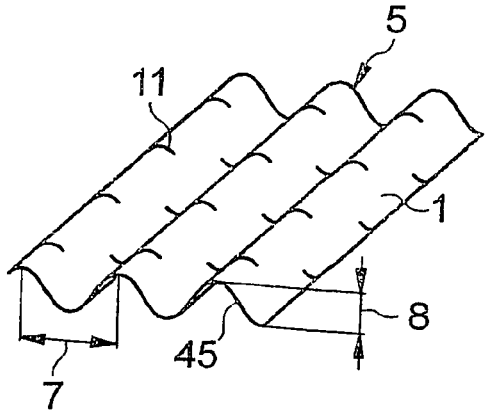

During a step shown in FIG. 6B, the sheet-metal strip 1 is deformed for the first time, producing a primary structure 5 with a first corrugation length 7. Accordingly, the sheet-metal strip 1 which has already been provided with holes 10 and slots 11 was then provided with a primary structure 5, for example using one of the shaping apparatuses 3 described above. The primary structure 5 is easy to recognize from the edge, with two similar, adjacent extremities (corrugation peaks 41 or corrugation valleys 42) describing the first corrugation length 7. A further criterion to be used to describe the primary structure 5 is a corrugation height 8. In this case, after the first deformation step, for example, the first corrugation height 8 is defined, and during this phase a ratio of corrugation length 7 to corrugation height 8 is less than 2.

Figure 6C:
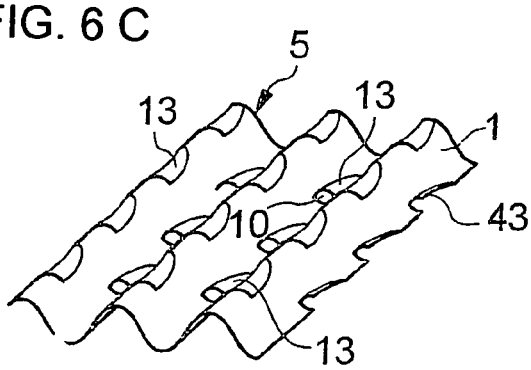

In a further deformation step illustrated in FIG. 6C, the secondary structure 13 is introduced into the sheet-metal strip 1. The illustrated secondary structure 13 again has holes 10 and guide surfaces 43 which are oppositely oriented. The secondary structure 13 is superimposed on the primary structure 5.

Figure 6D:
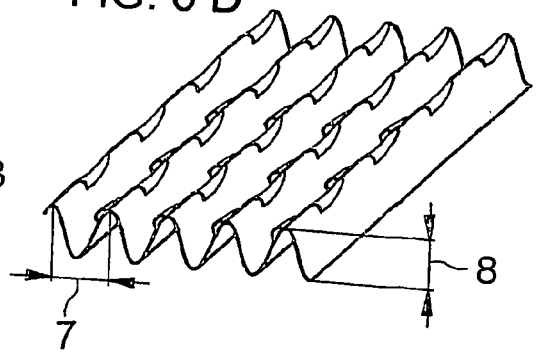

In a deformation step illustrated in FIG. 6D, the primary structure 5 is gathered up, condensed or deformed in such a way as to produce a second corrugation length 7, which is shorter than the first corrugation length 7. It can be seen from the illustration that the reduction in the corrugation length 7 brings about a corresponding increase in the corrugation height 8, i.e. the first corrugation height 8 is lower than the second corrugation height 8. The process shown herein allows the ratio of corrugation length 7 to corrugation height to be reduced further, for example to less than 1.5.

In principle, however, it should be pointed out at this time that the process steps in FIG. 6B and FIG. 6C can also be carried out in one production step. In other words, this means that the shaping apparatus 3 or the shaping tools 6 may be constructed in such a way that the primary structure 5 and the secondary structure 13 can be generated simultaneously upon contact with the sheet-metal strip 1.

Figure 7:
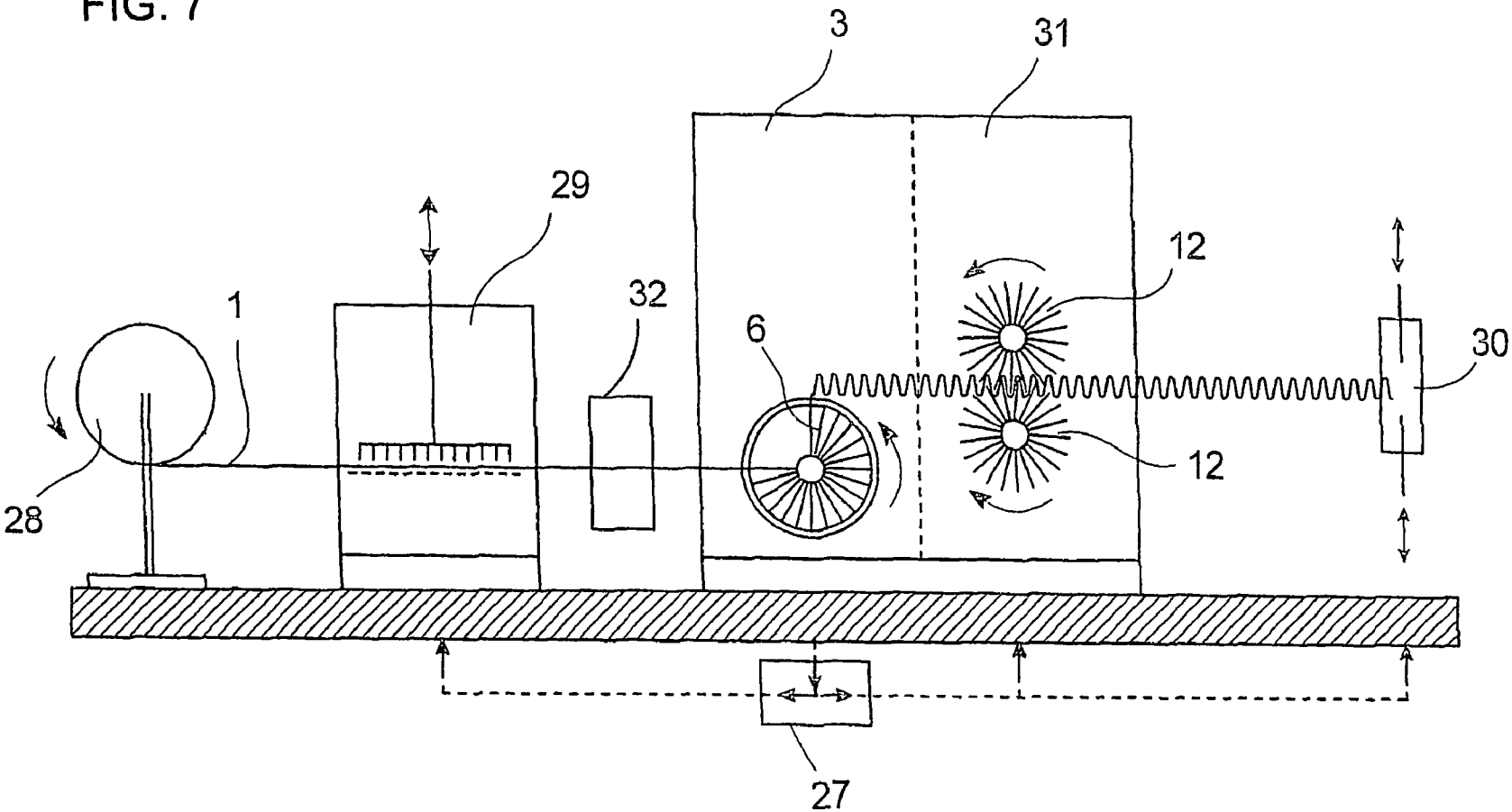
FIG. 7 is a partly sectional, side-elevational view depicting a production line for structured sheet-metal foils using the process according to the invention.

FIG. 7 diagrammatically shows the configuration of a production line which can be used to produce structured sheet-metal foils. Starting from a metal strip coil, on which the smooth, unstructured sheet-metal strip 1 is wound, the sheet-metal strip 1 is first of all fed through the use of a feed device 28 to a stamping device 29 where, for example, the openings 10 and/or slots 11, which are not illustrated in FIG. 7, are introduced into the metal strip 1. Then, the sheet-metal strip 1 is guided onward to an alignment device 32, which accurately checks the advance of the sheet-metal strip 1, for example by recording the stamped formations or holes 10 and slots 11. Then, the sheet-metal strip 1 is fed to the shaping apparatus 3. In the illustrated embodiment, the shaping tools 6 are once again in a radiating configuration. After it leaves the shaping apparatus 3, the structured sheet-metal strip 1 is then fed to a profiling device 31 which has two intermeshing profiling tools 12. As the sheet-metal strip 1 passes through the profiling tools 12, the secondary structure 13, which is not illustrated in FIG. 7, is formed. Finally, the completed sheet-metal strip 1 is also fed to a severing device 30, with which the sheet-metal strip 1 is sheared into sheet-metal foils 2 with a predetermined length and width.

As can also be seen from FIG. 7, the shaping apparatus 3 has a drive 27 which is used to drive the shaping tools 6. This drive is simultaneously available to drive at least the stamping device 29, the profiling device 31 and/or the severing device 30.

The process described herein and the apparatuses mentioned herein for producing structured sheet-metal strips are particularly cost-effective and reliable in operation. Undesirable deformation of the sheet-metal strip, which is undesirable in particular with a view toward use in exhaust systems of mobile internal combustion engines, is almost completely avoided. Moreover, extremely high cycle times and therefore a particularly high production rate of sheet-metal foils can be achieved.

We claim:

1. A process for producing a structured sheet-metal strip, the process comprising the following steps:

feeding a smooth sheet-metal strip along a guide direction to a shaping apparatus having a plurality of separate shaping tools;

introducing a primary structure into the smooth sheet-metal strip by individually displacing the plurality of separate shaping tools to move offset with respect to one another substantially perpendicularly to the guide direction to push the smooth sheet-metal strip into a mating die; and advancing the sheet-metal strip in the guide direction with the mating die while the shaping tools are disengaged from the primary structure of the sheet-metal strip.

2. The process according to claim 1, which further comprises severing the structured sheet-metal strip after the step of introducing the primary structure, to produce sheet-metal foils.

3. The process according to claim 1, wherein the primary structure of the structured sheet-metal strip has a corrugation length, a corrugation height and a ratio of the corrugation length to the corrugation height of less than 2.

4. The process according to claim 1, wherein the primary structure of the structured sheet-metal strip has a corrugation length, a corrugation height and a ratio of the corrugation length to the corrugation height of less than 1.5.

5. The process according to claim 1, wherein the sheet-metal strip is made from a high-temperature-resistant and corrosion-resistant material.

6. The process according to claim 5, wherein the high-temperature-resistant and corrosion-resistant material is at least one material selected from the group consisting of a material containing chromium, a material containing aluminum, and a material based on nickel.

7. The process according to claim 5, wherein the sheet-metal strip has a thickness of less than 0.11 mm.

8. The process according to claim 5, wherein the sheet-metal strip has a thickness of less than 0.06 mm.

9. The process according to claim 5, wherein the sheet-metal strip has a thickness of less than 0.03 mm.

10. The process according to claim 1, which further comprises introducing at least one of holes or slots into the sheet-metal strip before the step of feeding the sheet-metal strip to the shaping apparatus.

11. The process according to claim 10, which further comprises carrying out the step of introducing the holes or slots into the sheet-metal strip by a stamping manufacturing process.

12. The process according to claim 10, which further comprises providing the sheet-metal strip with a secondary structure through the use of intermeshing profiling tools, after the step of introducing the primary structure.

13. The process according to claim 12, wherein the secondary structure at least partially delimits the holes or slots in the sheet-metal strip.

* * * * *